United States Patent [19]

Anderson

[11] Patent Number: 4,775,344

[45] Date of Patent: Oct. 4, 1988

[54] METHOD AND APPARATUS FOR STEERING A WATER SKI

[75] Inventor: Edward A. Anderson, Houston, Tex.

[73] Assignee: E A Squared, Inc., Houston, Tex.

[21] Appl. No.: 93,628

[22] Filed: Sep. 8, 1987

[51] Int. Cl.[4] ..... A63C 15/00

[52] U.S. Cl. ..... 441/68; 114/153; 441/79

[58] Field of Search ..... 114/153, 39.2; 441/68, 441/79; 280/21 R

[56] References Cited

U.S. PATENT DOCUMENTS

| | | | |
|---|---|---|---|
| 2,241,733 | 5/1941 | Perry | 280/21 R |
| 3,201,807 | 8/1965 | Weaver | 441/79 |

FOREIGN PATENT DOCUMENTS

| | | | |
|---|---|---|---|
| 194765 | 1/1958 | Austria | 441/79 |
| 146240 | 6/1985 | European Pat. Off. | 114/39.2 |
| 2731266 | 2/1979 | Fed. Rep. of Germany | 114/39.2 |

*Primary Examiner*—Sherman D. Basinger
*Assistant Examiner*—Thomas J. Brahan
*Attorney, Agent, or Firm*—Hubbard, Thurman, Turner & Tucker

[57] ABSTRACT

A rudder-steerable water ski is provided including a pivotable shoe rotatable by the user to correspondingly move a ski rudder through a transmission mechanism. A V-shaped rudder may be used with at least one blade of the rudder remaining in the water when the ski is angled with respect to the surface of the water. According to the method of the present invention, the conventional water ski may be modified to provide the rudder-steerable capability of the invention.

15 Claims, 2 Drawing Sheets

METHOD AND APPARATUS FOR STEERING A WATER SKI

BACKGROUND OF THE INVENTION

1. Field of the Invention

The present invention pertains to a method for providing a water ski with a steering device and the completed apparatus of a steerable water ski.

2. Description of the Prior Art

Steering a conventional water ski may be achieved through leaning from side to side thus creating angular deflection and lateral forces on the bottom of the ski. Often a greater challenge is desired or a quicker turning response is desired for stunts.

SUMMARY OF THE INVENTION

The present invention provides apparatus for modifying an existing water ski to make it a rudder steerable water ski and provides a method of doing the same. The invention uses a pivoting shoe which rotates about an axis which is near the toe of one foot of the skier. The motion of the pivoting shoe is transmitted through a transmission mechanism to a rudder at the rear of the ski.

A V-shaped rudder may be used such that at least one blade of the V-shaped rudder remains in the water when the ski is angled with respect to the water. Fins taking on a two blade V-shape may also be fixed to the underside of the ski to gain the same advantage of having a fin in the water when the ski is angled.

BRIEF DESCRIPTION OF THE PREFERRED EMBODIMENTS

Figure 1:
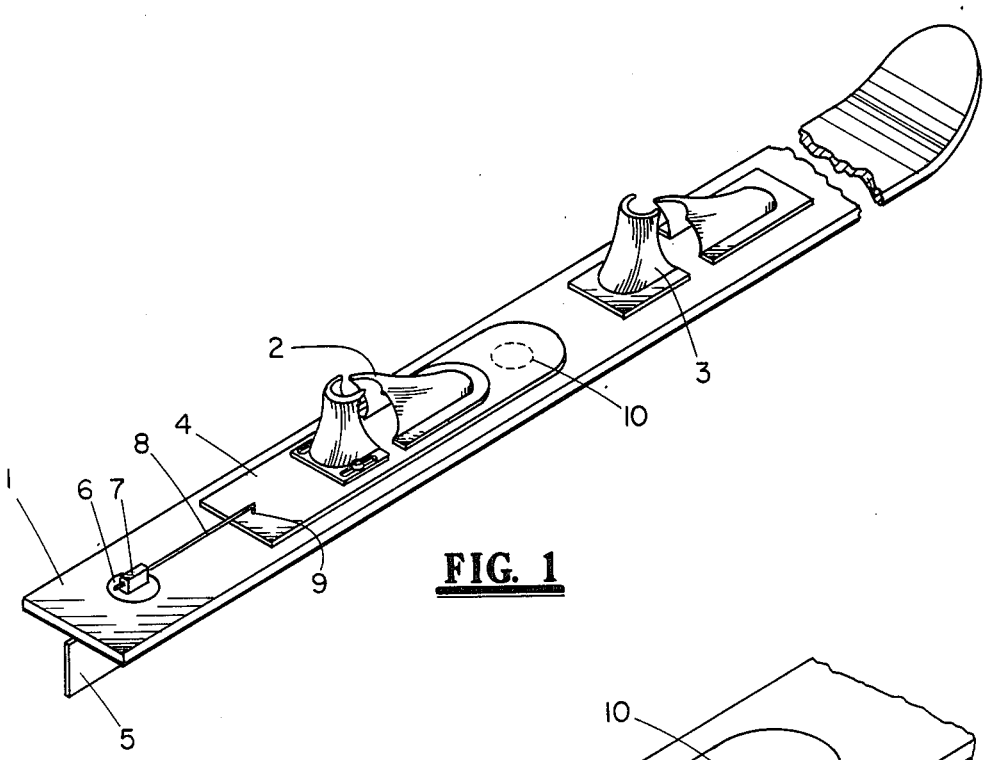
FIG. 1 is a perspective view of a water ski having a pivotable shoe connected to a slider-crank mechanism for driving the rudder.
Figure 3:
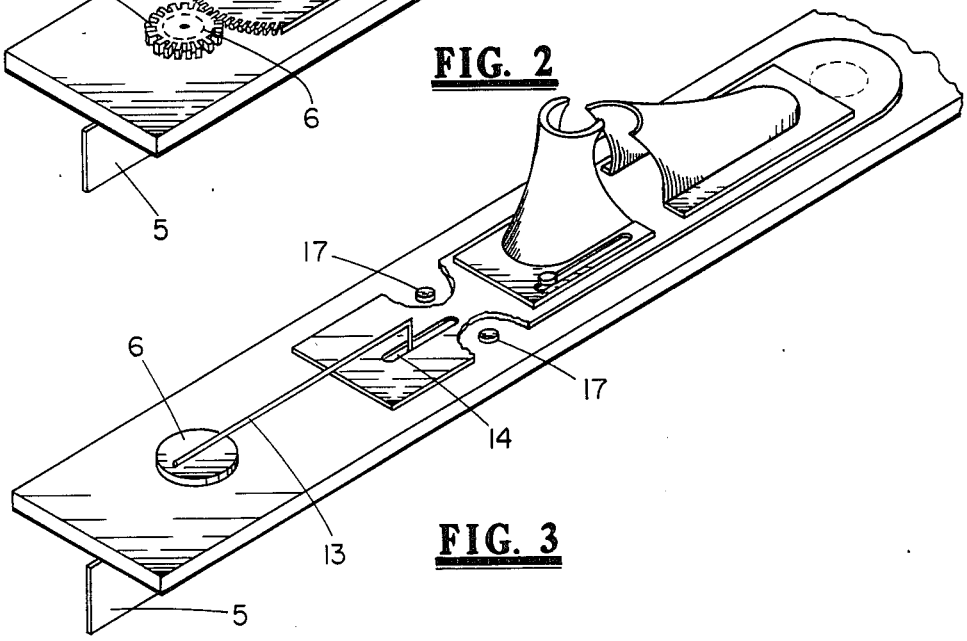
FIG. 3 is a further embodiment where an oblong hole formed in the base of the pivoting shoe along with a cooperating arm transmits motion from the pivoting shoe to the rudder in order to steer the ski.
Figure 4:
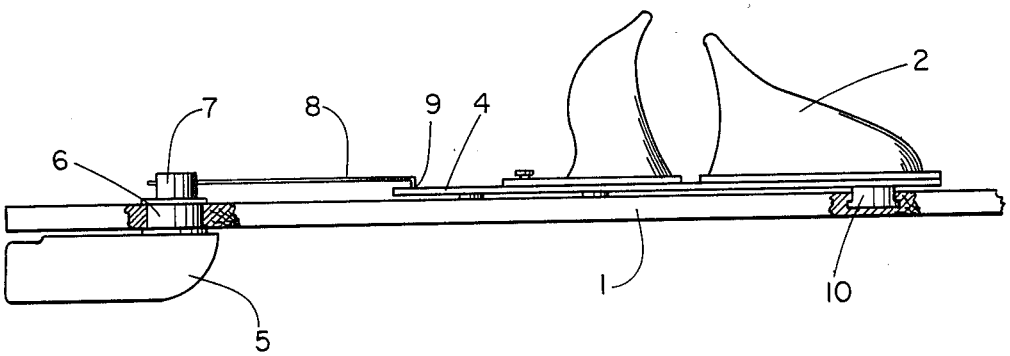
FIG. 4 is a side view of the embodiment of FIG. 1 showing the rudder with the ski body cut away.
Figure 5:
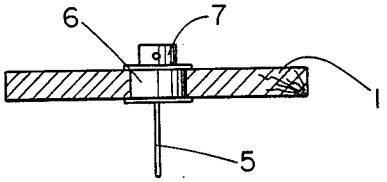
FIG. 5 is a cut away view of the rudder as viewed from the rear of the ski.

Referring to FIG. 1, a ski body 1 is shown having a rudder 5 which pivots about pivot shaft 6. Pivot shaft 6 is rotated by the force of a transmission mechanism such as gears 11, 12 or a slider crank mechanism 7, 8, 13, 14. A conventional fixed water ski shoe 3 is attached to the ski. Behind the fixed shoe is a pivoted shoe 2 having a base 4. The base 4 is mounted to the ski body 1 by a conventional pivoting fixture 10. This pivoting fixture 10 is able to withstand forces in all directions without becoming disconnected and is designed so that the base 4 may be easily removed from the ski body 1 when desired. As seen in FIG. 3, spacers 17 may be attached to the ski body 1 to lie between the base 4 and the ski body 1. The base rides on the spacers to reduce friction between the base 4 and the ski body 1. To the rear of the ski body 1 is a rudder 5 attached to a rudder pivot shaft 6. The rudder pivot shaft extends from below the ski to the upper surface of the ski and is able to withstand forces in all directions while allowing the rudder to turn freely about the axis of pivot shaft 6. The rudder pivot shaft 6 is rotated by a transmission mechanism, three possible embodiments of which are shown. Two types of slider-crank mechanisms are shown. FIG. 1 illustrates one type where a slider block 7 is fixed to the rudder pivot shaft 6. The slider block 7 receives one end of an arm 8, the opposite end of which is received in a pivot hole 9 formed in the base 4. The motion of the base is thereby transmitted to the rudder shaft. The distance from the base pivot 10 to the arm pivot 9 can be selected to achieve the desired movement ratio between the shoe 2 and the rudder 5.

Figure 2:
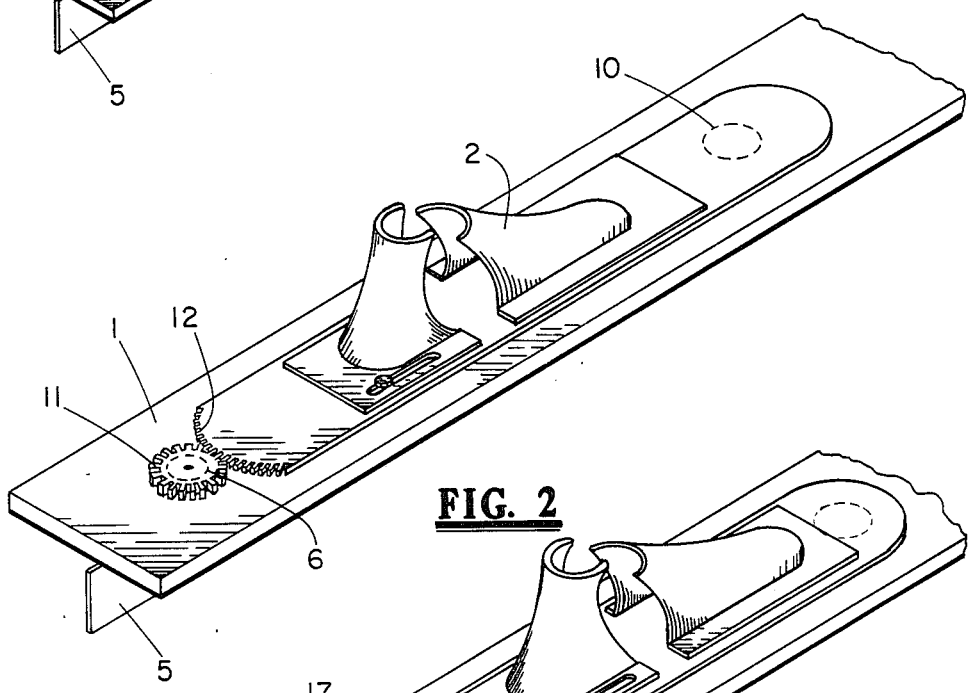
FIG. 2 is a further embodiment where a gear transmission is employed to transmit motion from a pivotable shoe to a rudder to steer the ski.

The embodiment of FIG. 3 shows another similar slider-crank mechanism where an arm 13 is fixed to the rudder pivot shaft at one end and the opposite end is received in an oblong hole 14 formed in the base. Again, the distances between pivot points may be selected to achieve the desired motion ratio. FIG. 2 shows a transmission mechanism comprised of gears where a gear 11 is fixed to the rudder pivot shaft 6. Gear teeth 12 are formed on the base 4 in an arc such that pivoting motion of the base 4 rotates the rudder through the cooperation of the gear teeth. The number of teeth on the gears is selected to achieve the proper ratio of movement.

Figure 6:
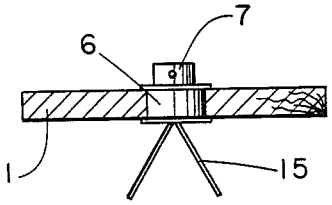
FIG. 6 is a cut away view of a V-shaped rudder as viewed from the rear of the ski.
Figure 7:
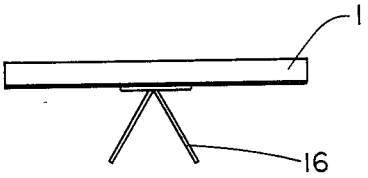
FIG. 7 is a view from the rear of the ski of V-shaped fins fixed to the underside of the ski.
Figure 8:
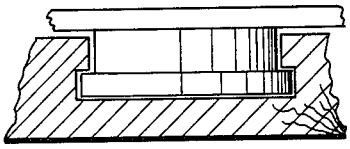
FIG. 8 is a cut away side view of the pivot fixture connecting the base of the pivotable shoe to the ski body.

The rudder 15 may be formed with two blades as seen in FIG. 6. This way at least one blade is well into the water and nearly vertical when the skier is leaning at an angle to the plane of the water.

A water ski having fixed fins in a V-shape is further disclosed such that one fin remains in the water and is vertical or nearly vertical when the ski is angled with respect to the plane of the water.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A steerable water ski, comprising:

a body means;

a first shoe means fixedly attached to the body means for receiving a first foot of the skier;

a second shoe means pivotably connected to the body means about a shoe pivot axis for receiving a second foot of the skier;

a rudder means pivotably connected to the body means about a rudder axis for controlling the direction of travel of the ski in water; and a mechanism for automatically transmitting pivotable motion of the second shoe means to an oppositely directed pivotable motion of the rudder means such that clockwise pivotable motion of the second shoe means about the pivot shoe axis produces counterclockwise pivotable motion of the rudder means about the rudder axis.

2. The apparatus of claim 1, wherein the second shoe means includes a planar base pivotably attached to the ski and in slidable engagement with an upper surface of the body means, and a foot receptacle attached to the planar base.

3. The steerable water ski of claim 2 wherein the rudder means is connected to the planar base by a slider-crank mechanism; whereby the slider-crank mechanism transmits motion from the planar base to the rudder means.

4. The steerable water ski of claim 2 wherein the mechanism is a gear means comprised of a first gear connected to the base and a second gear connected to the rudder means, whereby the first gear drives the second gear.

5. The steerable water ski of claim 1 wherein the mechanism is a slider-crank mechanism having an arm which drives the rudder means from motion supplied by the second shoe means.

6. The steerable water ski of claim 1 wherein the mechanism is a gear means.

7. The steerable water ski of claim 1 wherein the rudder means has two blades and is V-shaped.

8. A water ski having ski body means, a first shoe means fixedly attached to the ski body means, a second shoe means attached to the ski body means, and a rudder means attached to the ski body means for steering the ski, the apparatus further comprising:

first connection means for pivotably interconnecting the ski body means and the second shoe means about a shoe pivot axis;

second connection means for pivotably interconnecting the ski body means and the rudder means about a rudder axis; and translation means for automatically transmitting pivotable motion of the second shoe means to an oppositely directed pivotable motion of the rudder means such that clockwise pivotable motion of the second shoe means about the shoe pivot axis produces counterclockwise pivotable motion of the rudder means about the rudder axis.

9. The steerable water ski of claim 8, wherein the translation means is a slider-crank mechanism having an arm which drives the rudder means from motion supplied by pivoting said second shoe means.

10. The steerable water ski of claim 8, wherein the second shoe means includes a planar base, and the translation means comprises a first gear connected to the base and a second gear connected to the rudder means, whereby the first gear drives the second gear.

11. The steerable water ski of claim 8, wherein the rudder means has two blades and is V-shaped.

12. A method of modifying a water ski having a ski body, a first fixed shoe attached to the ski body, a second shoe attached to the ski body, and a rudder attached to the body for steering the ski, the method comprising:

pivotably connecting the second shoe to the ski body about a shoe pivot axis;

pivotably connecting the rudder to the ski body about a rudder axis; and mechanically interconnecting the second shoe and the rudder for transmitting pivotable motion of the second shoe to an oppositely directed pivotable motion of the rudder, such that clockwise pivotable motion of the second shoe about the pivot shoe axis produces counterclockwise pivotable motion of the rudder about the rudder axis.

13. The method of modifying a water ski as defined in claim 12, further comprising:

mounting the second shoe on a planar base in slidable engagement with an upper surface of the ski body; and providing a recepticle attached to the planar base.

14. The method of modifying a water ski as defined in claim 12, wherein the step of mechanically interconnecting the second shoe and the rudder further comprises:

providing a slider-crank connecting arm between the rudder and the second shoe.

15. The method as defined in claim 12, wherein the step of mechanically interconnecting the second shoe and the rudder further comprises:

providing a first gear affixed to the second shoe;

rotatably mounting a second gear about the rudder axis and in meshed engagemet with the first gear.

* * * * *